US010194690B2

(12) United States Patent
Jansen

(10) Patent No.: US 10,194,690 B2
(45) Date of Patent: Feb. 5, 2019

(54) POUCH MAKER FOR MAKING BLOCK-BOTTOM TOBACCO POUCHES

(71) Applicant: SLUIS CIGAR MACHINERY B.V., Kampen (NL)

(72) Inventor: Frans Jansen, Eefde (NL)

(73) Assignee: Sluis Cigar Machinery B.V., Kampen (NL)

( * ) Notice: Subject to any disclaimer, the term of this patent is extended or adjusted under 35 U.S.C. 154(b) by 622 days.

(21) Appl. No.: 14/856,710

(22) Filed: Sep. 17, 2015

(65) Prior Publication Data

US 2016/0082684 A1 Mar. 24, 2016

(30) Foreign Application Priority Data

Sep. 18, 2014 (NL) ..... 2013495

(51) Int. Cl.

| | |
|---|---|
| ***B31B 19/64*** | (2006.01) |
| ***A24F 23/02*** | (2006.01) |
| ***B31B 70/00*** | (2017.01) |
| ***B31B 70/64*** | (2017.01) |
| *B31B 160/10* | (2017.01) |

(Continued)

(52) U.S. Cl.

CPC ..... *A24F 23/02* (2013.01); *B31B 70/00* (2017.08); *B31B 70/64* (2017.08); *B31B 2150/00* (2017.08); *B31B 2155/00* (2017.08); *B31B 2155/001* (2017.08); *B31B 2155/0014* (2017.08); *B31B 2160/10* (2017.08); *B31B 2160/106* (2017.08); *B31B 2160/20* (2017.08)

(58) Field of Classification Search

CPC . A24F 23/02; B31B 2150/00; B31B 2155/00; B31B 2155/001; B31B 2155/0014; B31B 2160/106; B31B 2160/20

USPC ..... 493/189, 243, 244

See application file for complete search history.

(56) References Cited

U.S. PATENT DOCUMENTS 2,224,017 A * 12/1940 Gurwick ..... B29C 65/106 156/269
2,325,673 A * 7/1943 Gurwick ..... A24F 23/02 206/245

(Continued)

FOREIGN PATENT DOCUMENTS

| | | |
|---|---|---|
| DE | 8716803 U1 | 2/1988 |
| EP | 2087992 A1 | 8/2009 |

OTHER PUBLICATIONS

Search Report and Written Opinion for priority application NL 2013495 dated May 20, 2015.

*Primary Examiner* — Andrew M Tecco
*Assistant Examiner* — Nicholas Igbokwe
(74) *Attorney, Agent, or Firm* — Hoffmann & Baron, LLP

(57) ABSTRACT

A device for making tobacco pouches from a film includes a first folding station for receiving the film and providing a bottom fold in the film; a buffer station for buffering a length of film having the bottom fold; a second folding station for receiving the film having the bottom fold from the buffer station and providing a first fold; a second fold and a third fold in the film for defining the block-bottom, the first fold and third fold having a same fold direction and the second fold being located between the first and third fold and having a counter fold direction, where the first folding station is provided upstream of the buffer station and the second folding station is provided downstream from the buffer station.

19 Claims, 13 Drawing Sheets

(51) Int. Cl.

| | |
|---|---|
| *B31B 150/00* | (2017.01) |
| *B31B 155/00* | (2017.01) |
| *B31B 160/20* | (2017.01) |

(56) References Cited

U.S. PATENT DOCUMENTS

| | | | | | |
|---|---|---|---|---|---|
| 3,148,598 | A * | 9/1964 | Davis | B31B 70/00 | 156/202 |
| 3,228,583 | A * | 1/1966 | Dougherty | B31B 70/00 | 383/120 |
| 3,722,376 | A | 3/1973 | Wech | | |
| 4,680,024 | A | 7/1987 | Focke et al. | | |
| 4,881,933 | A * | 11/1989 | Wech | B31B 70/00 | 493/192 |
| 5,080,747 | A * | 1/1992 | Veix | B29C 65/18 | 156/352 |
| 5,830,118 | A * | 11/1998 | Nicholson | B31B 70/00 | 493/196 |
| 8,465,404 | B2 * | 6/2013 | Hadley | B65D 81/3858 | 493/210 |
| 2009/0197750 | A1 * | 8/2009 | Beckmann | B29C 65/18 | 493/11 |
| 2010/0022374 | A1 * | 1/2010 | Nagano | B31B 37/00 | 493/189 |
| 2010/0262273 | A1 * | 10/2010 | Dose | B29C 65/08 | 700/122 |

* cited by examiner

POUCH MAKER FOR MAKING BLOCK-BOTTOM TOBACCO POUCHES

CROSS-REFERENCE TO RELATED APPLICATIONS

This application claims the benefit of Netherlands Application No. 2013495, filed Sep. 18, 2014, the contents of which is incorporated by reference herein.

FIELD OF THE INVENTION

The present invention relates to a pouch maker for making block-bottom tobacco pouches and to a method of making tobacco pouches. The tobacco pouches are in particular roll-your-own tobacco pouches.

BACKGROUND OF THE INVENTION

Pouch making devices for making roll-your-own tobacco pouches are known. There are two types of roll-your-own tobacco pouches. A first type has a pillow shape. The lower end of the pouch more or less has a V-shape. A second type has block-bottom shape. A block-bottom shape is a known shape in the packaging industry. The bottom of the pouch has a certain width and is created by three folds which form a W-shape or at least shape which shows some resemblance to a W-shape. Both types are used.

Generally, these two types of pouches require different devices for making the pouches, because the shapes are very different. In the present invention, the insight was developed that it is possible to make both types of pouches with a single device.

Furthermore, the insight was developed that it is possible to increase the speed of making tobacco pouches. In the field of the art, there is a continuous need to increase the production speed of such devices.

Furthermore, the pouches are made from a film by applying heat welds on the film. After the heat welds are made the individual pouches are cut from the film. The weld station typically welds during a stop in a stop/go movement of the film. The folds are typically made when the film is moved at a constant speed. In order to make a transition from a constant movement to a stop go movement, a buffer device is required. In the present invention the insight was developed that there is a relationship between the accuracy of the folds and the overall arrangement of the buffer device and the folding devices. It was found that this relationship is in particular relevant for block-bottom pouches. Block bottom pouches have three folds which define the bottom, and these folds are sensitive to slip. In other words, the folds do not always stay in the required place after they have been made.

A further issue is the position of a paper or carton middle layer. Tobacco pouches are often made from a multi-layered film, comprising at least a first outer layer of plastic, a middle layer of paper or carton and another outer layer of plastic. When more layers are present, the middle layer may be an interior layer. Generally the paper or carton layer is not fastened to the plastic layers but simply positioned in between the outer layers. This creates a risk that the middle layer does not stay in the required position during further processing. When the weld seams are subsequently made, the paper or carton layer may be in a wrong position.

OBJECT OF THE INVENTION

It is an object to provide a pouch making device for block-bottom pouches which suffers less from a disadvantage of a moving interior layer of paper or carton.

It is an object to provide a pouch making device for block-bottom pouches which suffers less from a disadvantage of slipping folds of the block-bottom.

It is an object to provide a pouch making device which is faster than known pouch making devices.

It is another object to provide an alternative pouch making device.

It is yet another object to provide a pouch making device which is very effective.

It is another object to provide a pouch making device for making tobacco pouches, in particular roll-your-own tobacco pouches, wherein the device is capable of making both pillow-shaped pouches and block-bottom shaped pouches.

The same objects apply to the method according to the invention.

SUMMARY OF THE INVENTION

In order to achieve at least one of the objectives, the invention provides a device for making tobacco pouches from a film, the device comprising:

- a first folding station for receiving the film and providing a bottom fold in the film,
- a buffer station for buffering a length of film having the bottom fold,
- a second folding station for receiving the film having the bottom fold from the buffer station and providing a first fold, a second fold and a third fold in the film for defining the block-bottom, the first fold and third fold having a same fold direction and the second fold being located between the first and third fold and having a counter fold direction,
  - wherein the first folding station is provided upstream of the buffer station and the second folding station is provided downstream from the buffer station.

The invention provides an alternative to the prior art.

If a multi layered film with an interior paper or carton layer is used, the position of the buffer station upstream of the second folding station advantageously reduces the chance that the paper or carton layer displaces in the buffer station, because the film in the buffer may only have one fold, i.e. a bottom fold. It was found that this is an advantage over a situation wherein the buffer is positioned downstream of the second folding station. In that case the film would be buffered with three folds which can results in a moving paper or carton layer. Also in that case there may an increased chance of slipping folds. The invention advantageously avoids these potential problems.

In an embodiment, the first folding station is configured for receiving the film having a substantially horizontal transverse axis, wherein the first folding station comprises a folding guide and folding rollers for providing the bottom fold and for reorienting the transverse axis of the film from a substantially horizontal orientation to a substantially vertical orientation, wherein the bottom fold defines the lower edge of the film.

The reorientation allows both a reliable folding process and a reliable buffering process.

In an embodiment, the folding guide has a triangular shape wherein in top view the triangle points in the transport direction, the folding guide having a tip which forms the most downstream part of the folding guide. It was found that this folding guide combines reliability with simplicity.

In an embodiment, the folding guide is oriented downward when viewed in the transport direction, wherein the tip of the folding guide is the lowermost part of the folding guide. This allows the film to be folded upwards, positioning the bottom fold as the lower edge of the vertically oriented film.

In an embodiment, the folding guide has a left edge and a right edge wherein in use the film slides along the folding guide and is folded upwardly along the left and right edge, resulting in a folded film having a vertical orientation and a left part and a right part, wherein in particular the left and right part have different sizes. This allows easy control of the relative sizes of the left and right part.

In an embodiment, the tip of the folding guide defines the bottom fold in the film.

In an embodiment, the first folding station comprises two vertical rollers positioned just downstream of the folding guide, wherein the film travels through the rollers for pressing the folded film onto itself, thereby making the fold a lasting fold. Advantageously, the folds stay in the required positioned further downstream.

In an embodiment, the bottom fold extends in the longitudinal direction of the film. This will generally be the case.

In an embodiment, the buffer station comprises:

one or more fixed film guides and one or more movable film guides which are movable in a reciprocating manner in a direction toward the fixed guides and in a direction away from the fixed guides, an actuator for moving the movable film guides, wherein the fixed and movable film guides together define a zig-zag trajectory for the film having a variable length for varying the total length of film in the buffer station.

This embodiment of the buffer device was found to be very effective and reliable, keeping the folds in the required position while allowing a rapid and controlled variation in the buffered length.

In an embodiment, the buffer station receives the film in the folded state, the film having a single bottom fold, and is configured to buffer the film having a single bottom fold. It was found that this leads to less moving of a paper or carton layer (it is used) and less slip of the folds in comparison with a buffering of a film having three folds.

In an embodiment, the buffer station is configured to receive the film while it travels at an essentially constant speed and is configured to transform this essentially constant movement into a stop-go movement and to pay out the film in the stop—go movement, the film having a takt or cycle time and a travel distance between two stops. This allows a welding process further downstream on a stationary film.

In an embodiment, the one or more movable film guides are fixed to one another via a base part which slides along one or more rails in a reciprocating manner, wherein the actuator is connected to and acts on the base part. It was found that this setup of the base part allows good control over the buffer length In an embodiment, the buffer station is constructed to guide the film in a substantially horizontal transport direction. The horizontal direction is very practical and allows a convenient setup of the different processing stations along the line.

In an embodiment, the fixed and movable film guides are rollers which extend vertically. In an embodiment, the buffer station is constructed to guide the film in a substantially vertical orientation. The vertical rollers orient the film vertically, which was found to be very stable and practical.

In an embodiment, the second folding station comprises:

a widening member which extends substantially in a transport direction of the film, and wherein the film is moved along both a left side and a right side of said widening member, the bottom fold being moved underneath the widening member, wherein a width of the widening member increases in the transport direction, wherein a bottom part of the film is widened by the widening member when moving along the underside of the widening member, and a folding member which is constructed to engage the widened bottom part of the film from below and push upwardly into the widened bottom part for creating the first fold, second fold and third fold in the film.

Advantageously, the first, second and third fold can be made in a reliable and simple manner.

In an embodiment, the folding member has a pointy upper tip, in particular having a triangular shape. It was found that this allows an effective way of making the first, second and third fold.

In an embodiment, the second folding station comprises a pair of folding rollers positioned downstream from the folding member for pressing the folded film onto itself for creating lasting folds. The folding rollers advantageously create lasting folds.

In an embodiment, a guiding plate extends from the folding member and through a gap between the folding rollers to a position downstream of the folding rollers, wherein the film is pressed against both sides of the plate by the respective rollers. The guide plate further assists in making the three folds in a lasting manner.

In an embodiment, the widening member has a height and an underside, the underside being in particular a horizontal surface, and an upper side, wherein the widening member is oriented vertically, and wherein the widening member in particular has a widening section and a uniform section, the widening section having a width which increases in the transport direction and the uniform section being provided downstream from the widening section and having a width which is uniform in the transport direction. It was found that this shape enhances the reliability In an embodiment, the folding member is configured to engage the film at the bottom fold thereby reversing the direction of the bottom fold in order to transform the bottom fold into the second fold. Advantageously, the bottom fold is re-used and transformed into the second fold. This enhances the overall precision.

In an embodiment, the folding member of the second folding station is positioned downstream from the widening member of the second folding station. This was found to be very reliable.

In an embodiment, an upper tip of the folding member of the second folding station is located higher than an underside of the widening member of the second folding station.

In an embodiment, the second folding station is constructed to process the film in a substantially vertical orientation. A vertical orientation makes the overall process simpler.

In an embodiment, the second folding station is constructed to guide the film in a substantially horizontal transport direction.

In an embodiment, the first fold, the second fold and the third fold extend in the longitudinal direction of the film.

In an embodiment, the device further comprises a welding station for welding seams in the film for defining individual pouches by applying heat, the welding station being positioned downstream from the second folding station. The welding station is generally required to define the pouches in the folded film In an embodiment, the device comprises a first path extending between the buffer and the second folding station and a second path extending between the buffer and the welding station, wherein the device is constructed to alternate between a block-bottom mode and a pillow mode, wherein:

in the block-bottom mode the film is conveyed via the first path to the second folding station for making block-bottom pouches and in the pillow mode the film bypasses the second folding station via the second path in order to make pillow-shaped pouches instead of block-bottom pouches.

Alternatively, at least the widening member and the folding member of the second folding station may be removable for allowing the film to pass the second folding station without any folding step taking place.

This embodiment advantageously allows the production of two different types of pouches. In an embodiment, in top view the buffer station, the second folding station and the welding station are arranged in a triangle.

In an embodiment, the device comprises a support frame, a feed station having at least one reel holder for holding a reel on which the film is spooled and being configured to pay out the film from the reel, the welding station for welding seams in the film for defining individual pouches, wherein the feed station, the first folding station, the buffer station, the second folding station and the welding station are mounted on the same support frame. This creates a sturdy overall system. The same support frame may comprise various sub-frames which are interconnected.

In an embodiment, there is no processing step between the first folding station and the buffer station nor between the buffer station and the second folding station. This provides the benefit that the folds stay in the required position without any disturbance.

In an embodiment, the device comprises a film forming station which is positioned upstream of the first folding station, the film forming station having:

at least one guide for a first plastic film for forming a first outer layer, at least one insert unit for a paper or cardboard strip for forming a middle layer at least one guide for a second plastic film for forming a second outer layer, wherein the film forming station is constructed to provide the paper or cardboard strip between the two plastic films and to interconnect the three films into a single film.

The film comprising three layers may also be spooled from a roll.

In an embodiment:

the first folding station is configured for receiving the film having a substantially horizontal transverse axis (34), wherein the first folding station comprises a folding guide (36) and folding rollers (37A, 37B) for providing the bottom fold and for reorienting the transverse axis of the film from a substantially horizontal orientation to a substantially vertical orientation, wherein the bottom fold defines the lower edge of the film, and wherein the buffer station (18) comprises:

one or more fixed film guides (40A, 40B, 40C) and one or more movable film guides (41A, 41B) which are movable in a reciprocating manner in a direction toward the fixed guides and in a direction away from the fixed guides, an actuator (46) for moving the movable film guides, wherein the fixed and movable film guides together define a zig-zag trajectory (43) for the film having a variable length for varying the total length of film in the buffer station, and wherein the buffer station is constructed to guide the film in a substantially horizontal transport direction, and wherein the buffer station is constructed to guide the film in a substantially vertical orientation, wherein the second folding station comprises:

a widening member (60) which extends substantially in a transport direction of the film, and wherein the film is moved along both a left side (61A) and a right side (61B) of said widening member, the bottom fold being moved underneath the widening member, wherein a width (64) of the widening member increases in the transport direction (47), wherein a bottom part (66) of the film is widened by the widening member when moving along the underside of the widening member, and a folding member (68) which is constructed to engage the widened bottom part of the film from below and push upwardly into the widened bottom part for creating the first fold, second fold and third fold in the film, wherein the second folding station is constructed to process the film in a substantially vertical orientation, and wherein the second folding station is constructed to guide the film in a substantially horizontal transport direction.

It was found that with this configuration a very effective way of making block-bottom pouches is possible.

The present invention further relates to a method of making tobacco pouches from a film, the method comprising:

providing a bottom fold in the film, buffering a length of film, providing a first fold, a second fold and a third fold in the film for defining the block-bottom, the first fold and third fold having a same fold direction and the second fold being located between the first and third fold and having a counter fold direction, wherein the bottom fold is provided prior to the buffering and the first fold, second fold and third folds are provided after the buffering.

The method provides the same advantages as the device.

In an embodiment, the film comprises at least three layers:

a first outer layer made from plastic, a second outer layer made from plastic, and a middle layer positioned between the first and second outer layer, the middle layer being made from paper or cardboard, This is a widely used type of film for tobacco pouches. This type may be used for block-bottom pouches and for pillow pouches, but mostly for block-bottom pouches. The present invention is very suitable for handling this type of film In an embodiment:

the first folding station receives the film having a substantially horizontal transverse axis, wherein the first folding station comprises a folding guide and folding rollers and provides the bottom fold and reorients the transverse axis of the film from a substantially horizontal orientation to a substantially vertical orientation, wherein the bottom fold defines the lower edge of the film, and wherein the buffer station comprises:

one or more fixed film guides and one or more movable film guides which move in a reciprocating manner in a direction toward the fixed guides and in a direction away from the fixed guides, an actuator which moves the movable film guides, wherein the fixed and movable film guides together define a zig-zag trajectory for the film having a variable length and vary the total length of film in the buffer station, and wherein the buffer station guides the film in a substantially horizontal transport direction, and wherein the buffer station guides the film in a substantially vertical orientation, wherein the second folding station comprises:

a widening member which extends substantially in a transport direction of the film, and wherein the film is moved along both a left side and a right side of said widening member, the bottom fold being moved underneath the widening member, wherein a width of the widening member increases in the transport direction, wherein a bottom part of the film is widened by the widening member while moving along the underside of the widening member, and a folding member which engages the widened bottom part of the film from below and pushes upwardly into the widened bottom part and creates the first fold, second fold and third fold in the film, wherein the second folding station processes the film in a substantially vertical orientation, and wherein the second folding station is constructed to guide the film in a substantially horizontal transport direction.

This embodiment of the method allows a very effective production of block-bottom pouches.

Typically, the tobacco pouch is a block-bottom pouch for roll-your-own tobacco.

The film generally is an endless film sheet which is spooled from a roll. Obviously, the film sheet has an end when it is spooled from a roll but it is very long relative to the length of an individual pouch.

In an embodiment, the film is buffered in a folded state, having a single bottom fold.

These and other aspects of the invention will be more readily appreciated as the same becomes better understood by reference to the following detailed description and considered in connection with the accompanying drawings in which like reference symbols designate like parts.

DETAILED DESCRIPTION OF THE INVENTION

Figure 1:
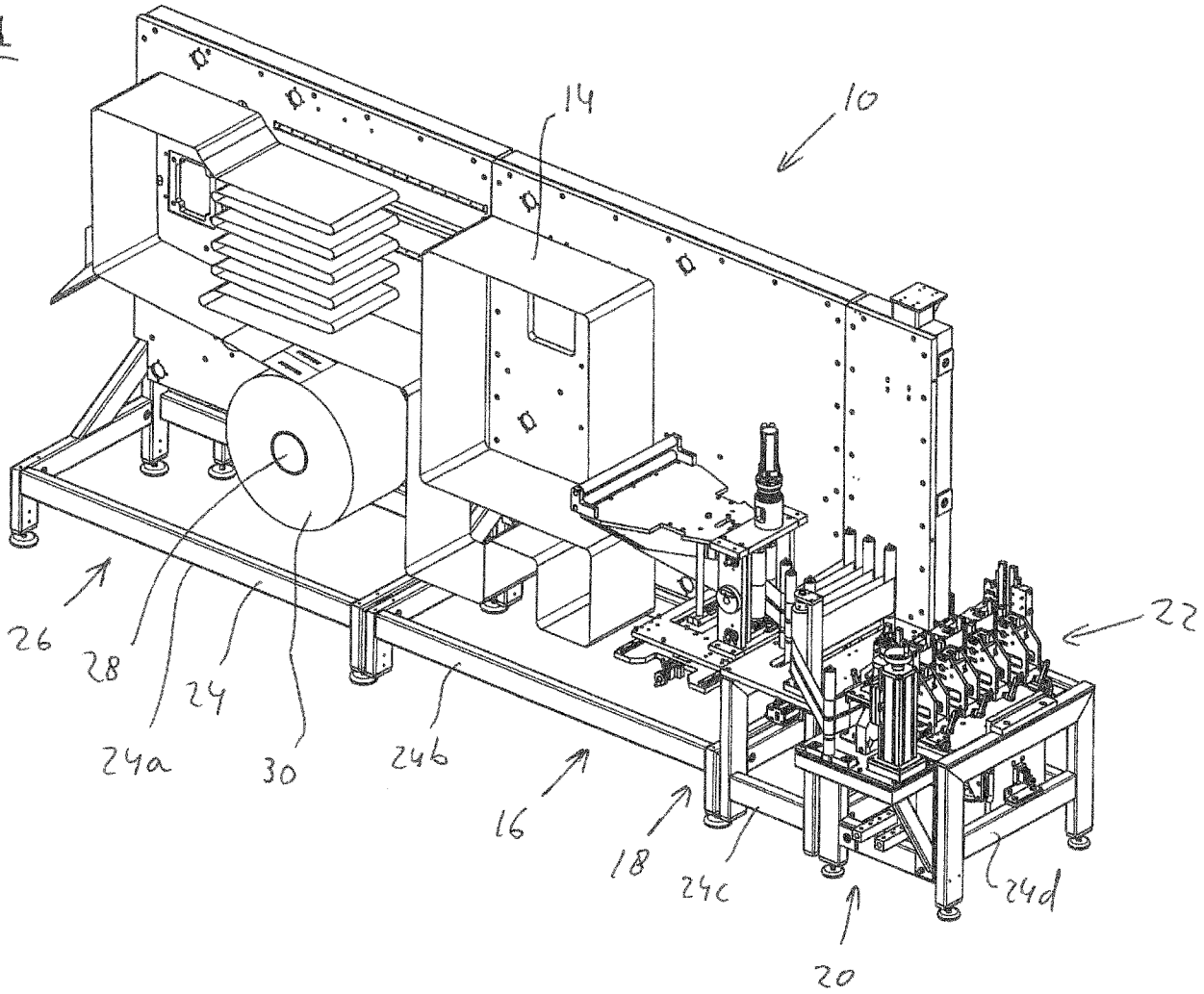
FIG. 1 shows a general view of the device according to the invention.
Figure 2A:
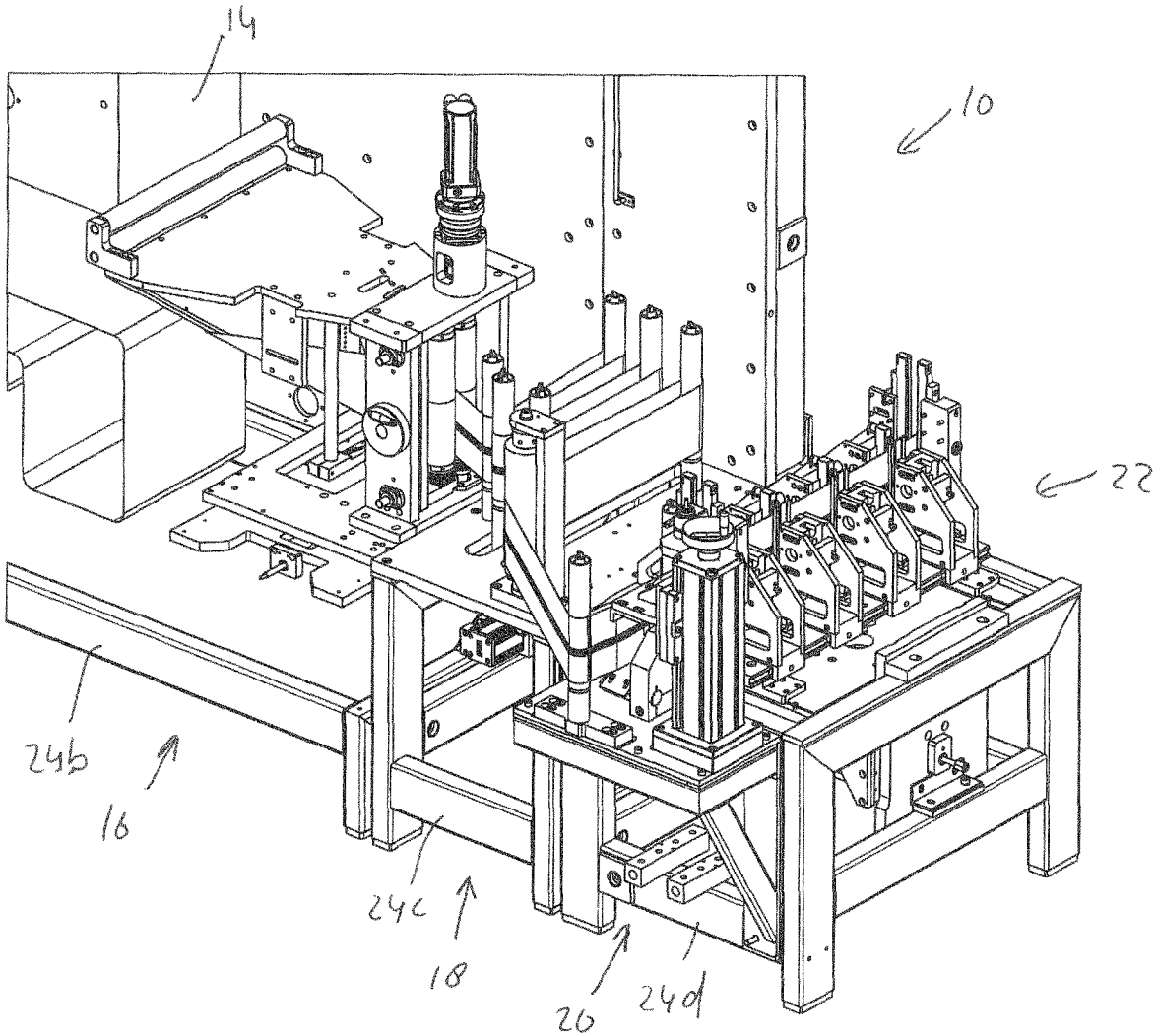
FIG. 2A shows a general view of the device according to the invention with more detail.
Figure 2B:
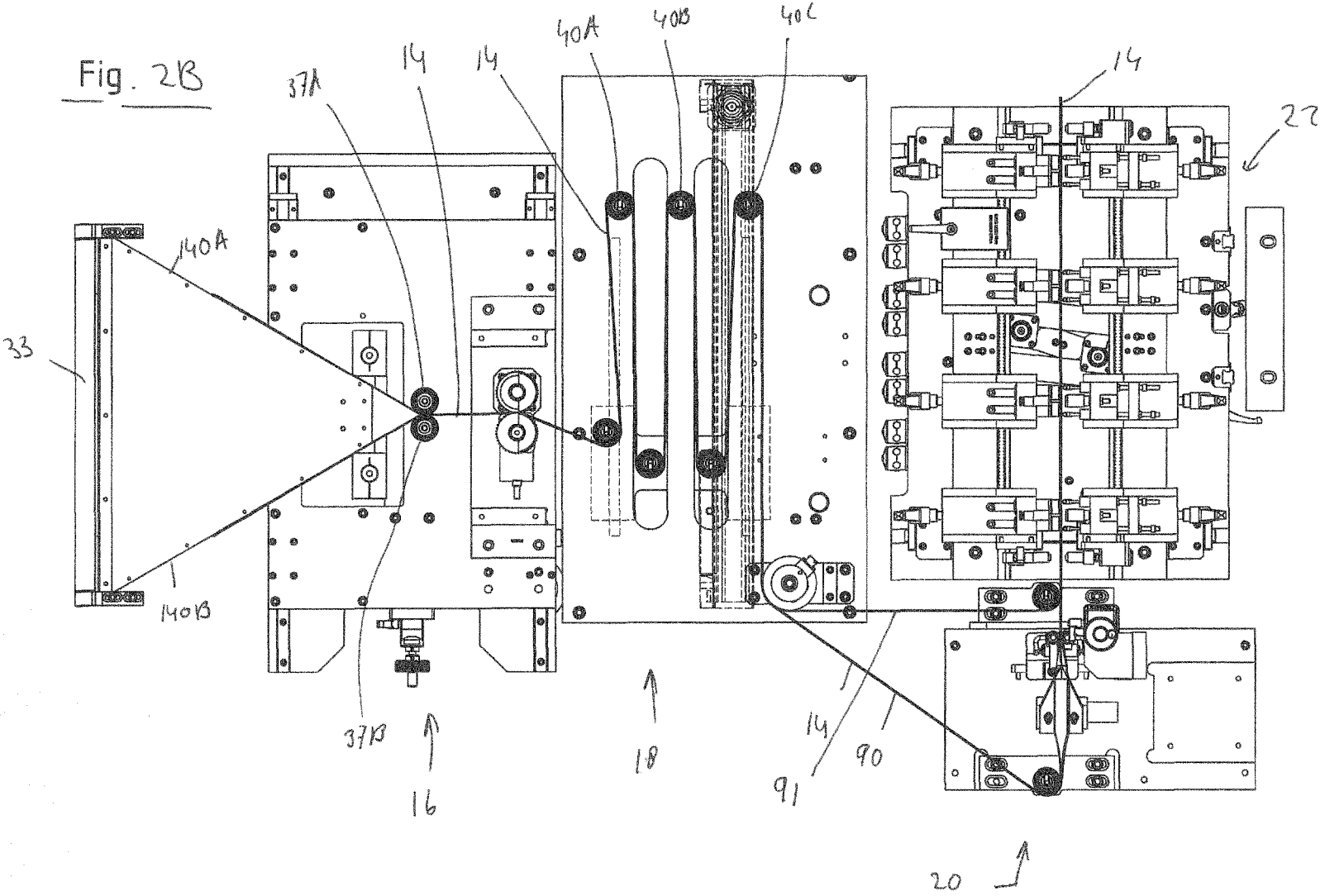
FIG. 2B shows a general top view of the device according to the invention with more detail.

Turning to FIGS. 1, 2A and 2B, the general layout of a device 10 for making tobacco pouches 12 (discussed with reference to in figure x) from a film 14 is shown. The device 10 is an assembly line. The film 14 typically is an endless film sheet which is spooled from a roll.

The device 10 comprises a first folding station 16 for receiving the film 14. The first folding station provides a bottom fold 18 in the film. The device 10 comprises a buffer station 18 for buffering a length of film having the bottom fold. The device 10 further comprises a second folding station 20 for receiving the film from the buffer station and providing a first fold, a second fold and a third fold in the film for defining the block-bottom of the pouches.

The first folding station is provided upstream of the buffer station and the second folding station is provided downstream from the buffer station.

In this embodiment, the device 10 further comprises a welding station 22, as will generally be the case. The welding station is constructed to weld seams in the film for defining individual pouches. The seams are welded by applying heat. The film generally comprises at least one thermoplastic layer which may be welded with heat. The welding station is positioned downstream from the second folding station.

The first fold and the third fold have a same fold direction and the second fold is located between the first and third fold and having a counter fold direction, The device further comprising a support frame 24 and a feed station 26 having at least one reel holder 28 for holding a reel 30 on which the film is spooled. The feed station 26 is configured to pay out the film from the reel 30. A drive is may be provided for the reel holder, or alternatively, the film may be pulled from the reel. Further rollers or guides are provided to guide the film through the feed station 26

The feed station, the first folding station, the buffer station, the second folding station and the welding station are mounted on the same support frame or at least on interconnected sub-frames 24*a*, 24*b*, 24*c*, 24*d*.

Turning to FIG. 2B, a first path 90 extends between the buffer station 18 and the second folding station 20 and a second path 91 extends between the buffer station 18 and the welding station 22. The device 10 is capable of switching between a block-bottom mode and a pillow mode.

In the block-bottom mode the film is conveyed via the first path 90 to the second folding station for making block-bottom pouches and in the pillow mode the film bypasses the second folding station via the second path 91 in order to make pillow-shaped pouches instead of block-bottom pouches. In this way a single device can make both pouches. It is also possible to remove In top view the buffer station 18, the second folding station 20 and the welding station 22 are arranged in a triangle.

There is no processing step between the first folding station 16 and the buffer station 18 nor between the buffer station 18 and the second folding station 20.

The buffer station receives the film in the folded state, but with a single fold. If the buffer station would be positioned downstream from the second folding station and upstream of the welding station, the buffer station would have to buffer the film having three folds, i.e. the first fold, second fold and third fold. It was found that this disadvantageously leads to instability of the folds, i.e. the folds do not stay in the required position.

The First Folding Station

Figure 3:
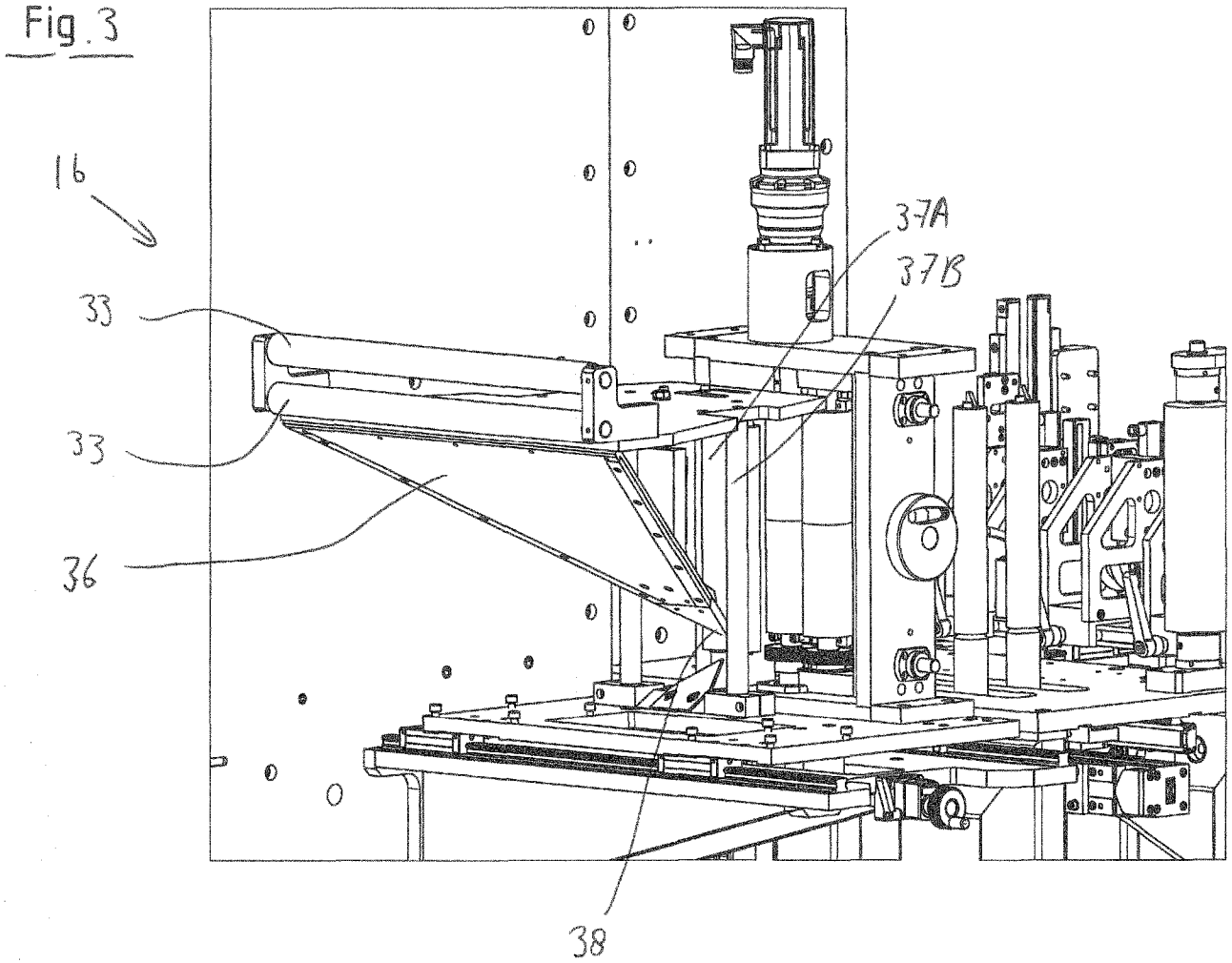
FIG. 3 shows an isometric view of the first folding station.
Figure 4:
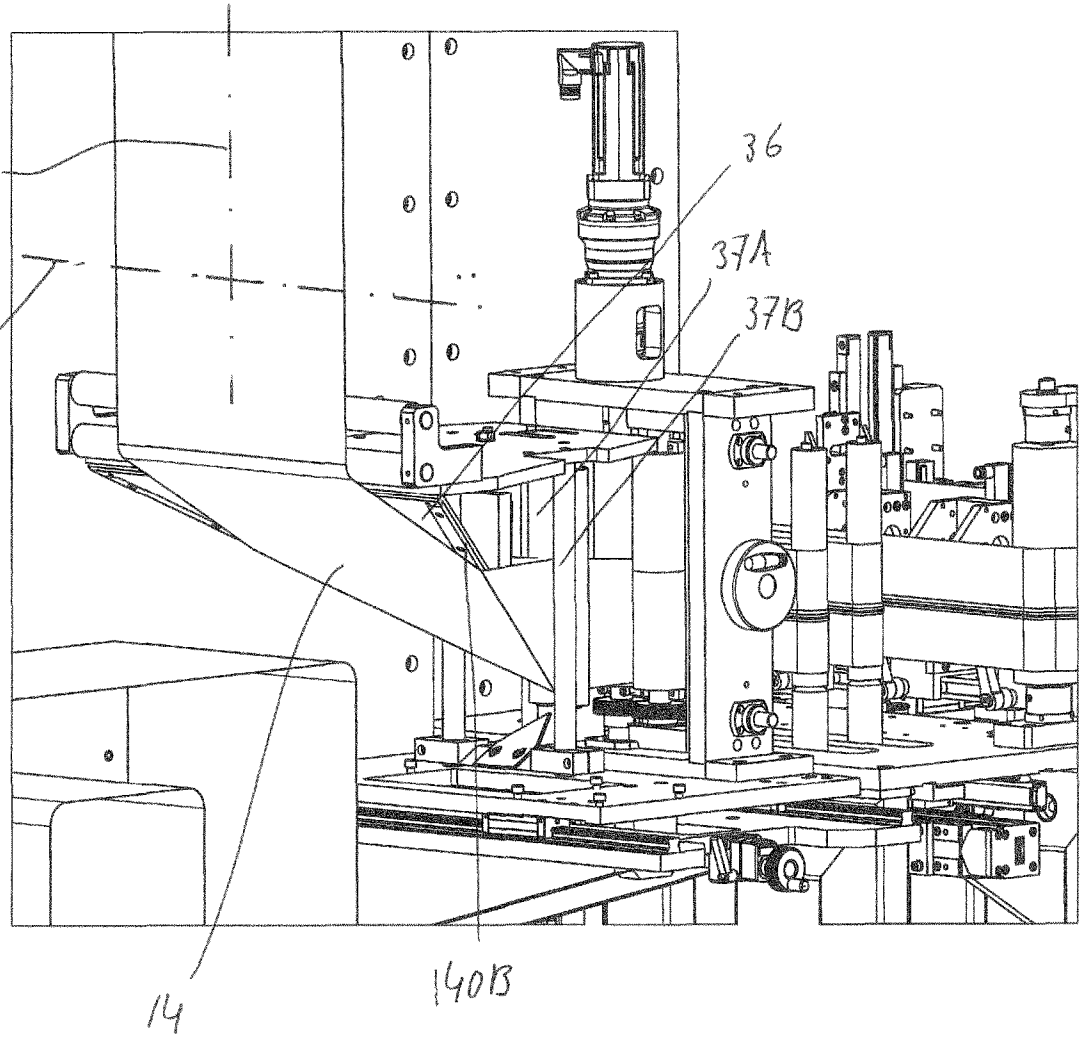
FIG. 4 shows an isometric view of the first folding station with film in it.
Figure 5:
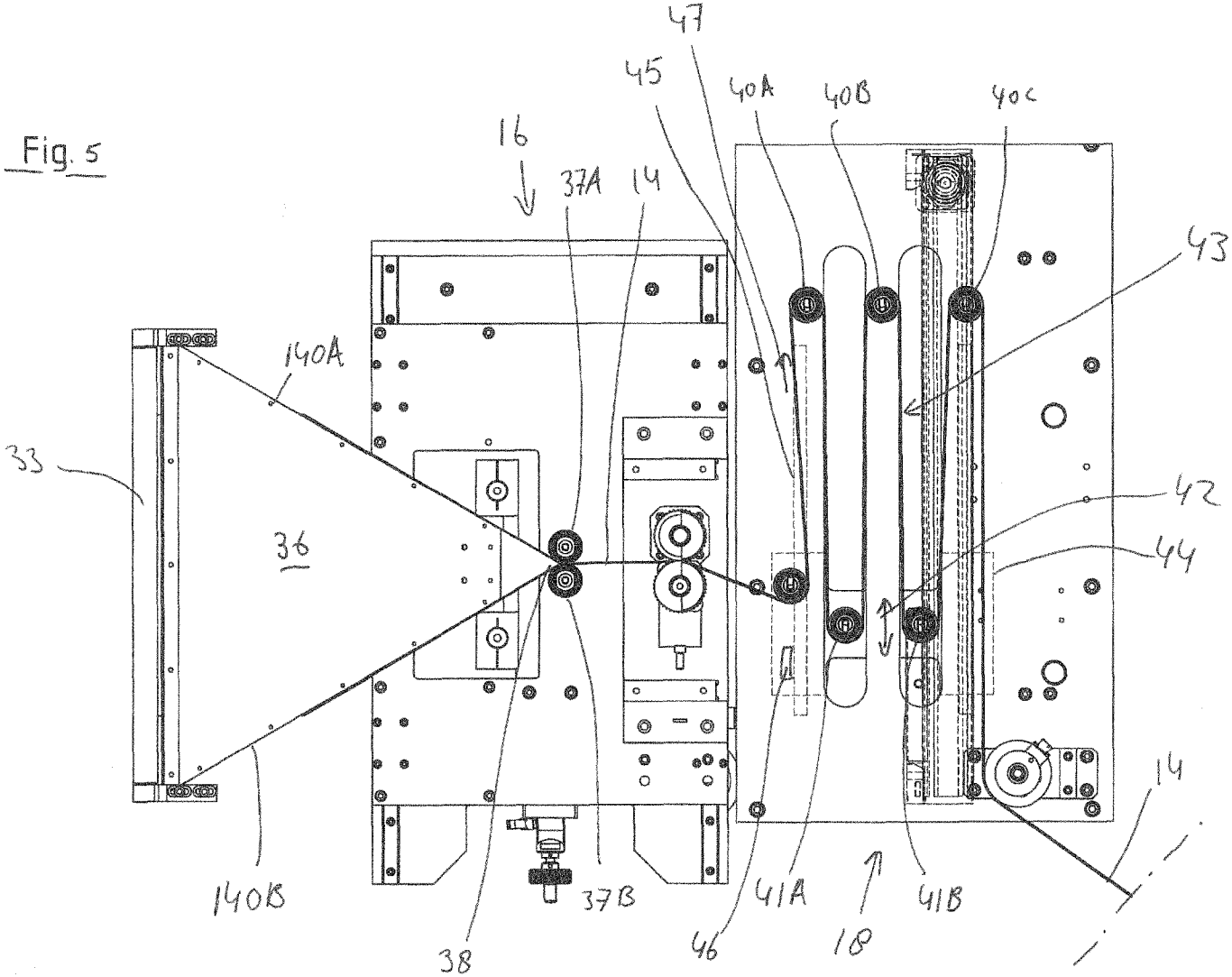
FIG. 5 shows a top view of the first folding station and the buffer station.

Turning to FIGS. 3, 4 and 5, the first folding station 16 is configured for receiving the film having a substantially horizontal transverse axis 34 (see FIG. 4). The longitudinal axis 35 may extend vertically, horizontally or be inclined.

The first folding station comprises a folding guide 36. The first folding station may comprise auxiliary rollers or guides 33 for guiding the film 14 in the correct manner to the folding guide 36. The first folding station comprises vertical folding rollers 37A, 37B for providing the bottom fold and for reorienting the transverse axis of the film from a substantially horizontal orientation to a substantially vertical orientation. The bottom fold defines the lower edge of the film. The folding rollers press firmly against one another and are positioned just downstream of the folding guide 36. The folding rollers may be adjustable. The folding guide may also be adjustable.

The folding guide 36 has a triangular shape. In top view, the triangle points in the transport direction (the downstream direction). The folding guide 36 has a tip 38 which forms the most downstream part of the folding guide. The tip may be located between the folding rollers and just upstream of the narrowest part of a gap between the folding rollers.

The folding guide 36 is oriented downward when viewed in the transport direction, and the tip 38 of the folding guide is the lowermost part of the folding guide.

The folding guide has a left edge 140A and a right edge 140B. In use, the film 14 slides along the folding guide 36 and is folded upwardly along the left and right edge, resulting in a folded film having a vertical orientation and a left part and a right part. In particular the left and right parts have different sizes, as is customary for roll-your-own tobacco pouches.

The tip 38 of the folding guide 36 defines the bottom fold in the film 14 as the film moves along the tip 38.

The film travels through the folding rollers 37A, 37B for pressing the folded film onto itself, thereby making the fold a lasting fold.

The skilled person will understand that the bottom fold extends in the longitudinal direction of the film. In FIGS. 3, 4 and 5 the bottom fold is not visible very well, because the tip 38 is positioned almost at the folding rollers 37A, 37B. Nonetheless, obviously the bottom fold is formed where the film leaves the tip 38.

Figure 6:
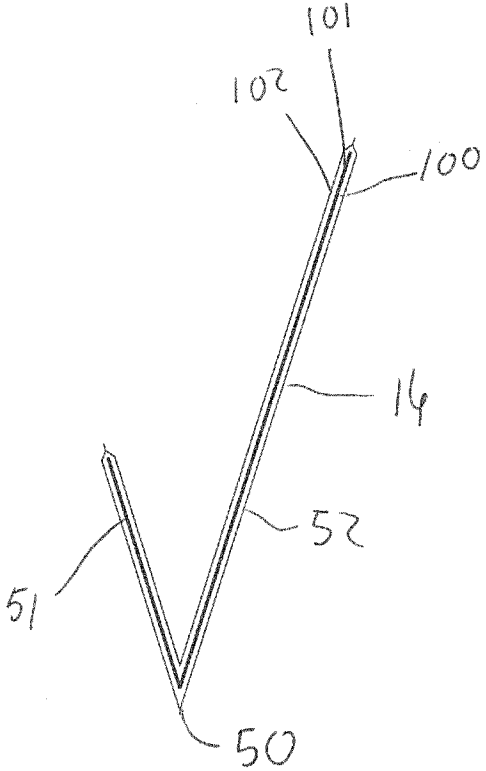
FIG. 6 shows a sectional view of the film having a single, bottom fold.
Figure 8:
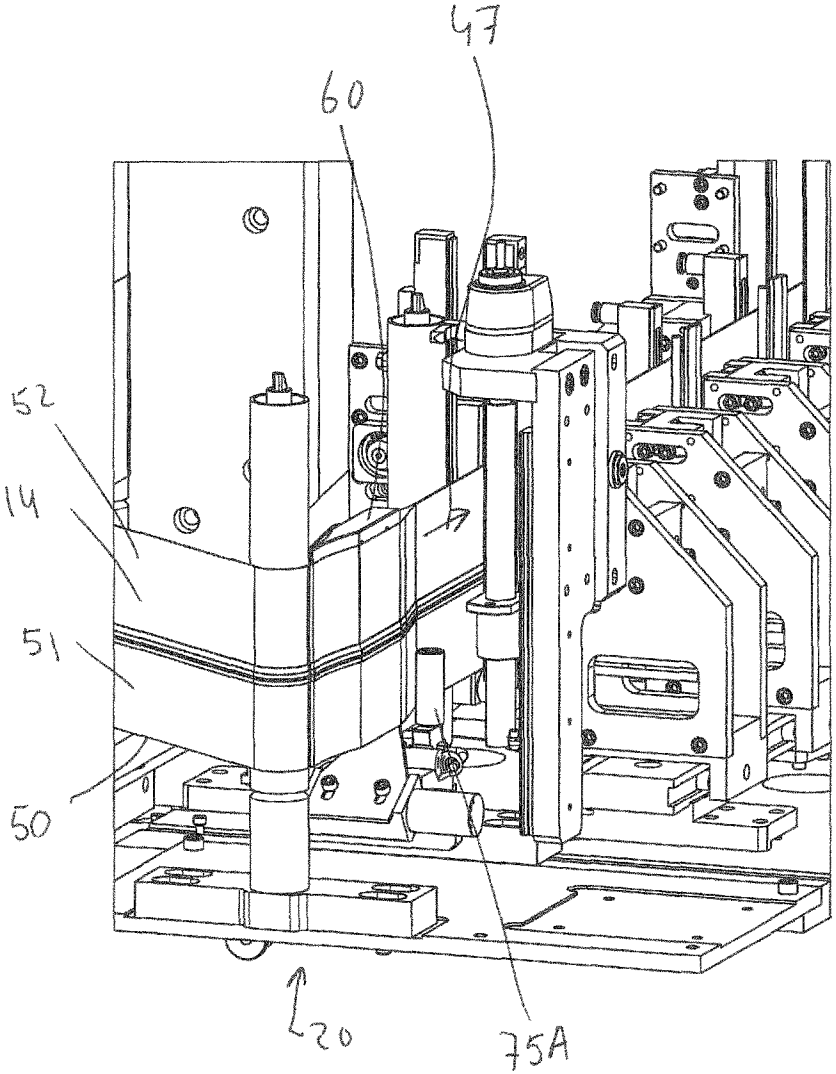
FIG. 8 shows an isometric view of the second folding station.
Figure 9:
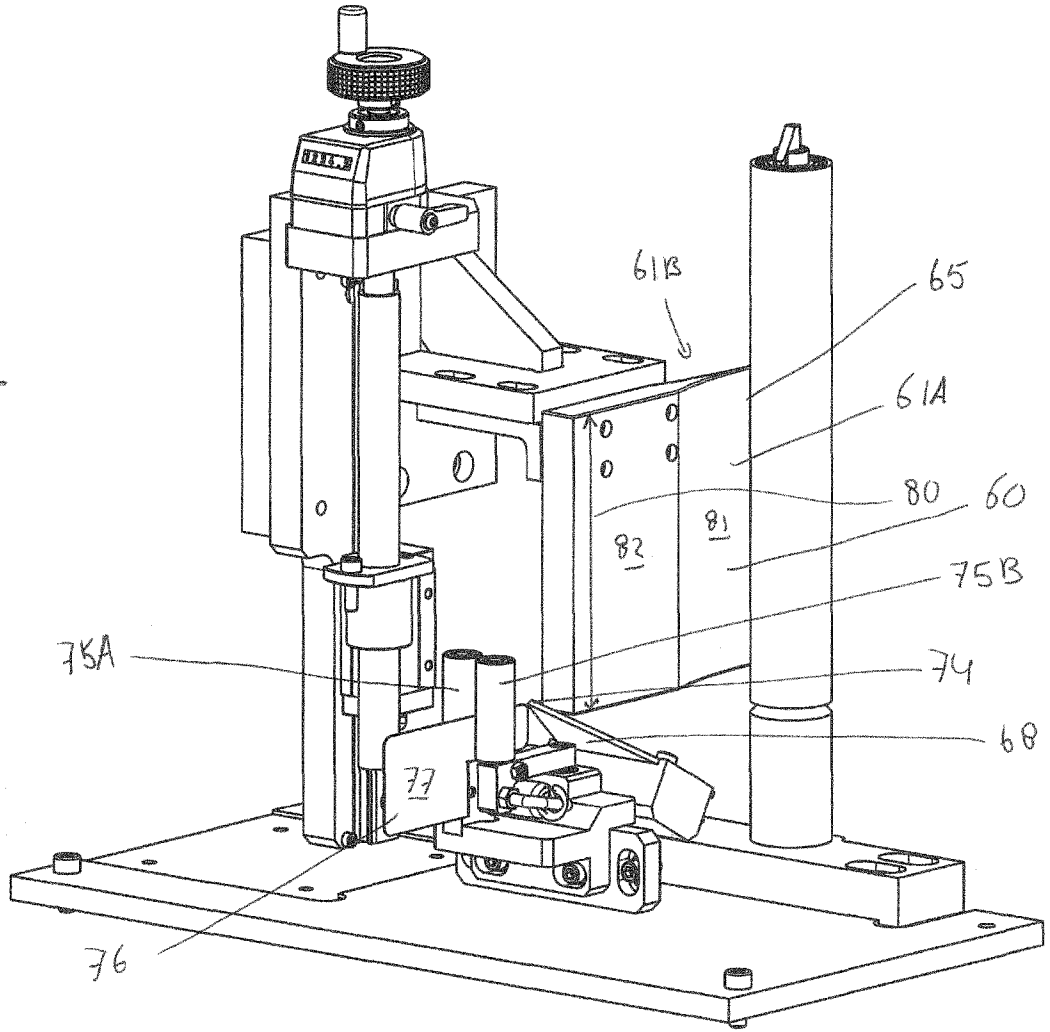
FIG. 9 shows another isometric view of the second folding station.
Figure 10:
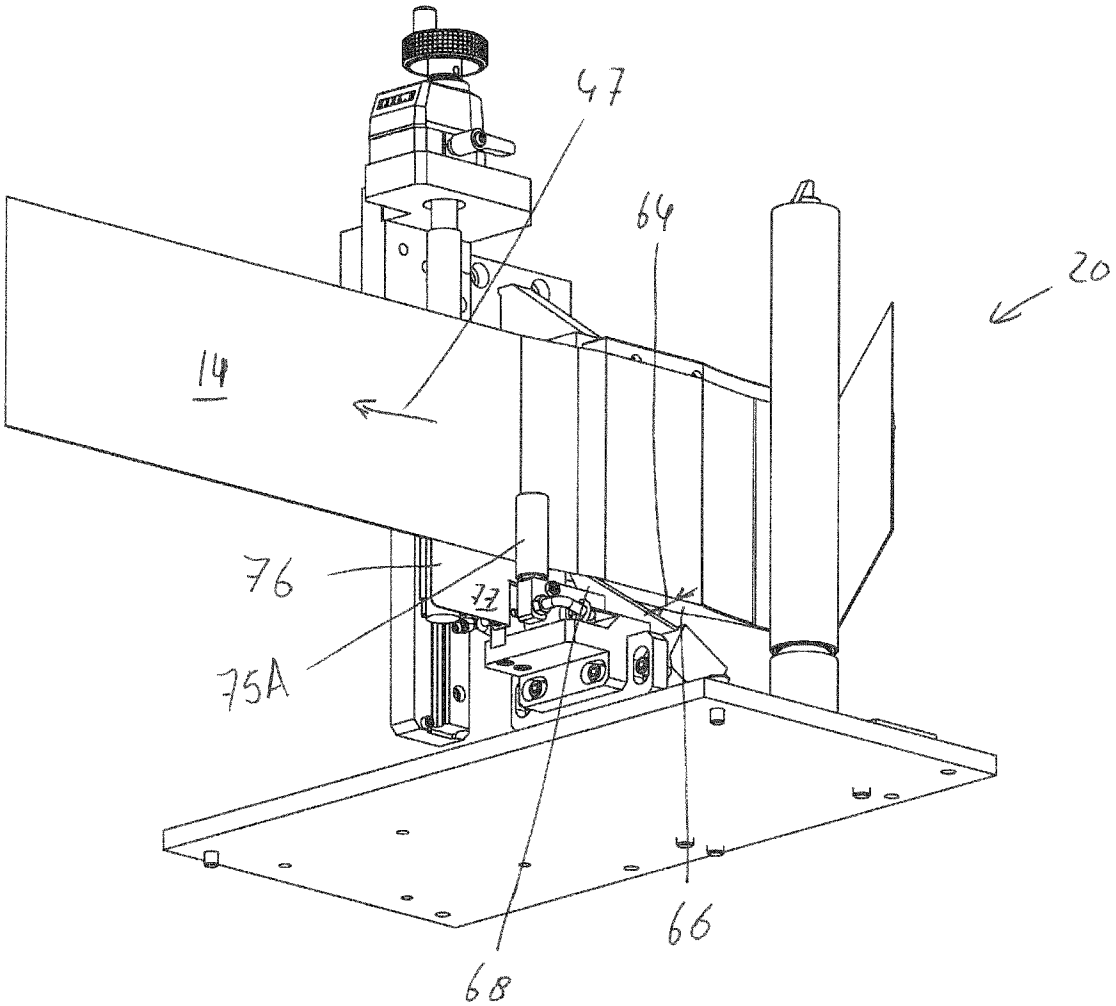
FIG. 10 shows another isometric view of the second folding station.
Figure 11:
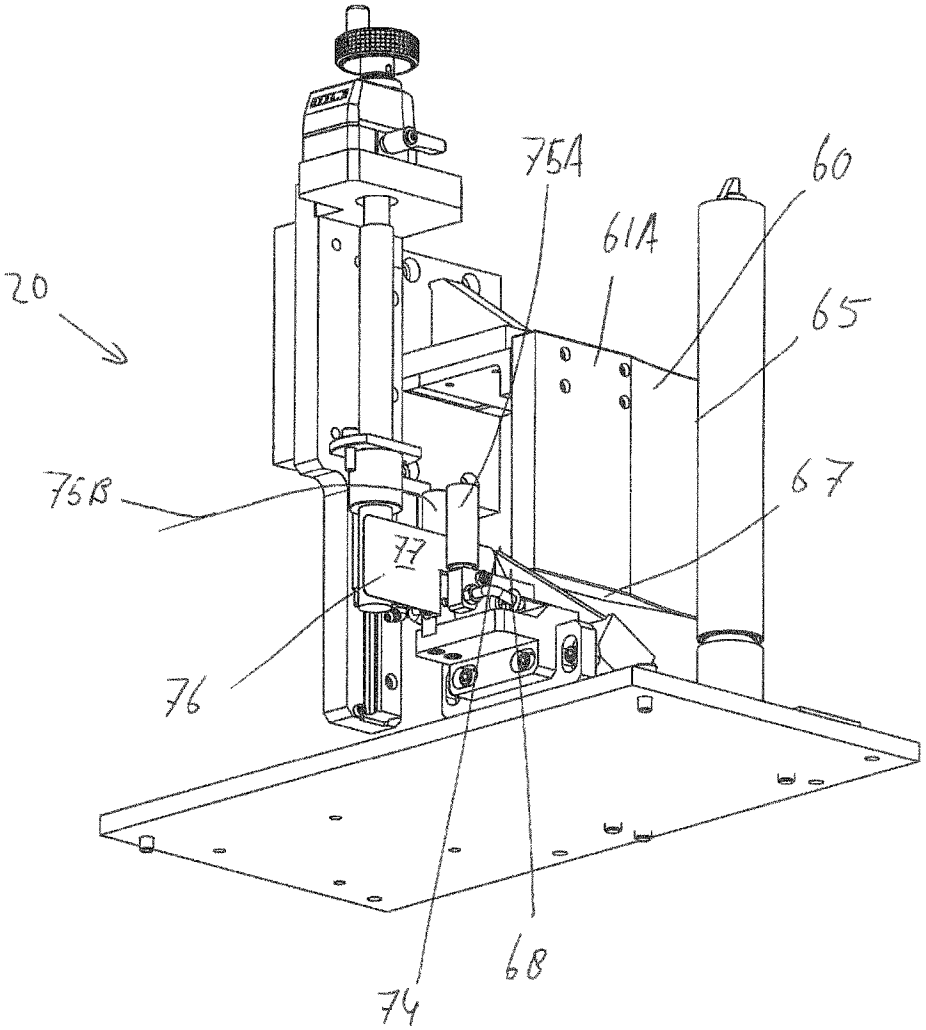
FIG. 11 shows yet another isometric view of the second folding station, from below.

Turning to FIG. 6, the general shape of the film when it leaves the first folding station is clarified. The film 14 has a bottom fold 50, a left part 51 and a right part 52. The left part and right part typically have different sizes. In FIG. 6 the film is shown in a V-configuration for clarity purposes, but the skilled person will understand that in the shown embodiment, when the folded film leaves the first folding station, the left and right part 51, 52 make contact with one another and are both oriented vertically.

The Buffer Station

Returning to FIG. 5, the buffer station 18 comprises one or more fixed film guides 40 (indicated with 40A, 40B, 40C) and one or more movable film guides 41 (indicated with 41A, 41B). The movable film guides are movable in a reciprocating manner in a direction toward the fixed guides and in a direction away from the fixed guides as is indicated with arrow 42. In this way the distance between the fixed film guides and the movable film guides can be varied between a certain minimal distance and a certain maximal distance.

The buffer station comprises an actuator for moving the movable film guides. The fixed film guides 40 and movable film guides 41 together define a zig-zag trajectory 43 for the film having a variable length for varying the total length of film in the buffer station. The fixed and movable film guides are rollers which extend vertically. Other types of guides are possible.

The buffer station is configured to receive the film while it travels at an essentially constant speed. By varying the distance between the fixed film guides and the movable film guides, the buffer is capable of transforming the essentially constant movement into a stop-go movement and to pay out the film in the stop—go movement. In the stop/go movement, the film has a takt or cycle time and a travel distance between two stops. A takt or cycle time may be referred to as the time between two movements, for example two movements if the stop-go or stop/go assembly line.

The movable film guides 41 are fixed to one another via a base part 44 which slides along one or more rails 45 in a reciprocating manner. The actuator 46 is connected to and acts on the base part. The actuator 46 will typically be a servo, but alternatives are conceivable. The actuator 46 may be mounted on the base part 44 and act on the rails 45

The buffer station is constructed to guide the film in a substantially horizontal transport direction 47. The buffer station is constructed to guide the film in a substantially vertical orientation.

The Second Folding Station

Turning to FIGS. 8, 9, 10 and 11, the second folding station comprises a widening member 60 which extends substantially in a transport direction 47 of the film 14. The widening member has a left side 61A and a right side 61B. The first part 51 and second part 52 of the film are disengaged from one another by the widening member 60. The film is moved along both the left side 61A and the right side 61B of said widening member. The first part 51 moves along the right side and the second part 52 moves along the left side.

The bottom fold 50 is moved underneath the widening member 60. A width 64 of the widening member increases in the transport direction 47 starting from a leading edge 65. The width is symmetric relative to the leading edge, i.e. the widening member extends to the left of the leading edge over a same distance as to the right.

A bottom part 66 (FIG. 10) of the film is widened by the widening member when moving along the underside of the widening member.

Figure 7:
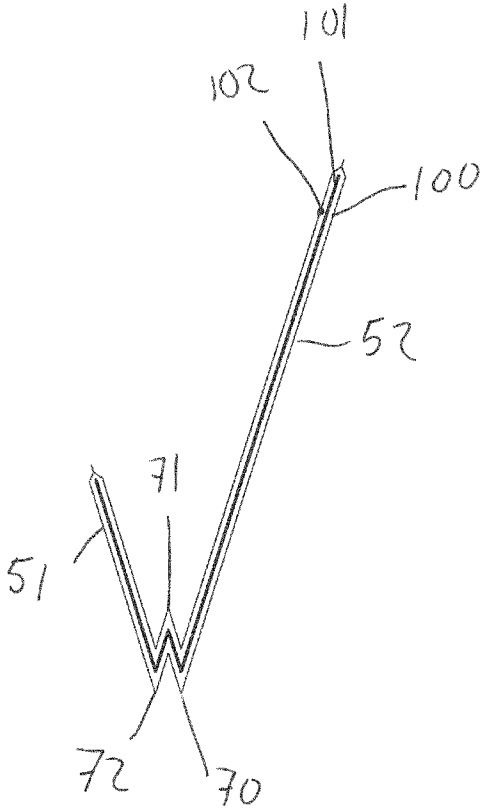
FIG. 7 shows a sectional view of the film having three folds.

A folding member 68 is provided downstream from the widening part. The folding member is constructed to engage the widened bottom part of the film from below and push upwardly into the widened bottom part for creating the first fold 70, second fold 71 and third fold 72 in the film. These folds are not clearly visible in FIGS. 8-11 but are shown in FIG. 7. The first fold, the second fold and the third fold extend in the longitudinal direction of the film.

In the actual configuration shown in FIGS. 8-11, the parts 51 and 52 are engaged both upstream and downstream from the second folding station.

The folding member has a triangular shape and a pointy upper tip 74.

The second folding station comprises folding rollers 75A, 75B positioned downstream from the folding member 68 for pressing the folded film 14 onto itself for creating lasting folds 70, 71, 72. The folding rollers have vertical axes.

A guiding plate 76 extends from the folding member 68 and through a gap which is present between the folding rollers to a position downstream of the folding rollers. The guiding plate 76 extends upwards into the middle portion of the W-shape from below and holds the second fold in place. An upper edge of the guiding plate 76 engages the second fold. The film 14 is pressed against both sides 77 of the guiding plate by the respective rollers.

The widening member has a height 80 and an underside 67. The underside 67 is in particular a horizontal surface. The widening member has an upper side. The widening member is oriented vertically, and wherein the widening member in particular has a widening section 81 and a uniform section 82, the widening section having a width which increases in the transport direction and the uniform section being provided downstream from the widening section and having a width which is uniform in the transport direction.

The folding member 68 is configured to engage the film at the bottom fold 50 thereby reversing the direction of the bottom fold 50 in order to transform the bottom fold into the second fold 71.

An upper tip 74 of the folding member 68 of the second folding station is located higher than an underside 67 of the widening member of the second folding station.

The second folding station is constructed to process the film in a substantially vertical orientation. The second folding station is constructed to guide the film in a substantially horizontal transport direction 47.

The film 14 may be formed in a film forming station which is positioned upstream of the first folding station 16. The film forming station comprises:

at least one guide for a first plastic film for forming a first outer layer 100, at least one guide for a paper or cardboard strip for forming a middle layer 101, at least one guide for a second plastic film for forming a second outer layer 102, wherein the film forming station is constructed to provide the paper or cardboard strip between the two plastic films and to interconnect the three films into a single film.

This kind of film forming station is known in the prior art and produces a film comprising a first outer layer 100 made from plastic, a second outer layer 102 made from plastic, and a middle layer 101 positioned between the first and second outer layer, the middle layer being made from paper or cardboard.

The film 14 and in particular the middle layer 102 of paper or carton may be provided with creased lines or perforations in the designated positions of the first, second and third folds in order to facilitate the folding process.

The position of the bottom fold together with the dimensions of the widening member and the folding member determines the position of the first, second and third fold In operation, the process comprises:

providing a bottom fold 50 in the film, buffering a length of film, providing a first fold 70, a second fold 71 and a third fold 72 in the film for defining the block-bottom, the first fold 70 and third fold 72 having a same fold direction and the second fold 71 being located between the first and third fold and having a counter fold direction, The bottom fold is provided prior to the buffering and the first fold, second fold and third folds are provided after the buffering.

Figure 12:
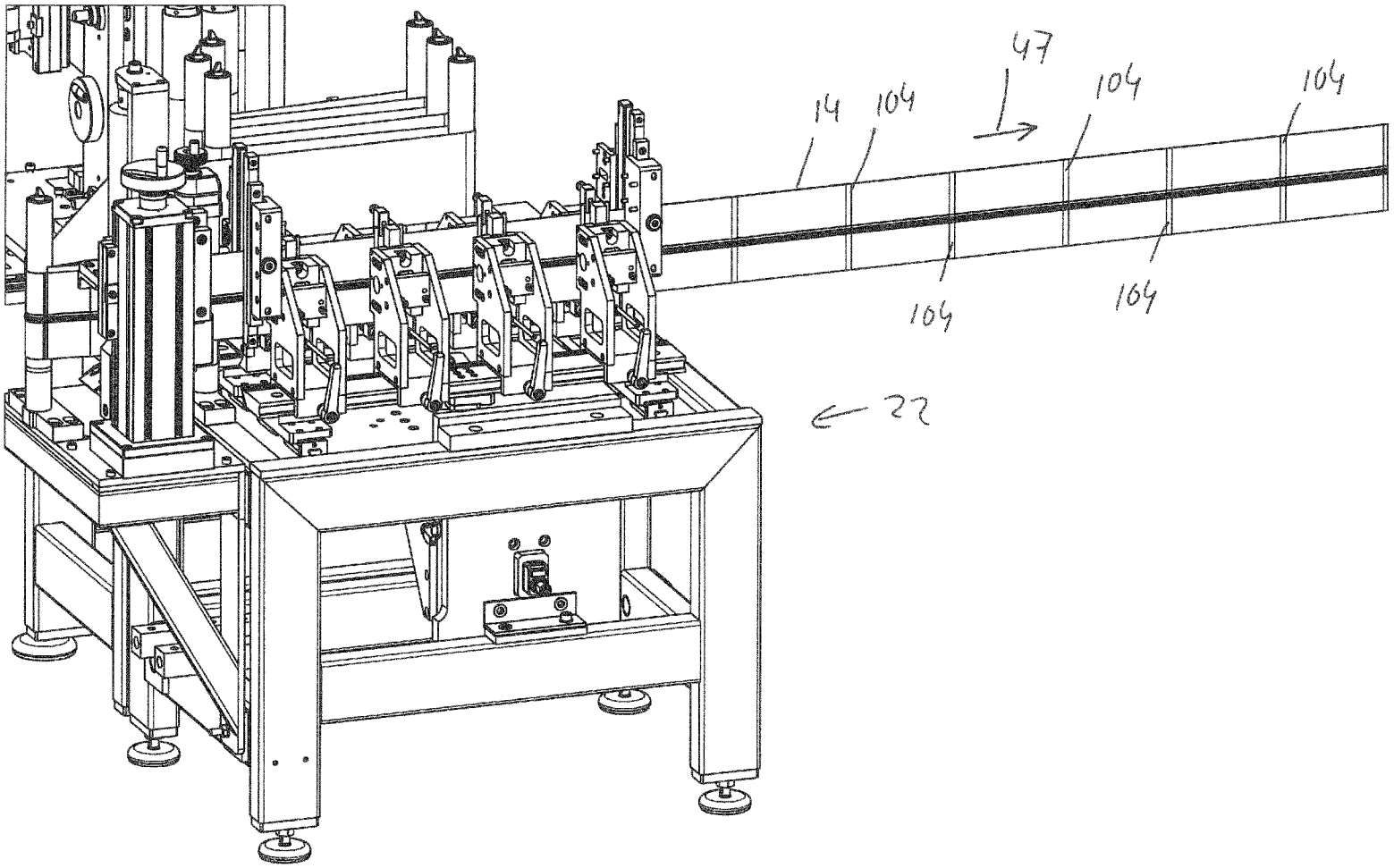
FIG. 12 shows an isometric view of a welding station and the resulting seams in the film.

Turning to FIG. 12, the welding station 22 is shown and the film 14 which leaves the welding station. Seams 104 are shown which extend transverse to the longitudinal direction of the film 14. The seams 104 may be double seams and define the borders of the individual pouches. Further downstream the film is cut along the seams to make the individual pouches.

Figure 14:
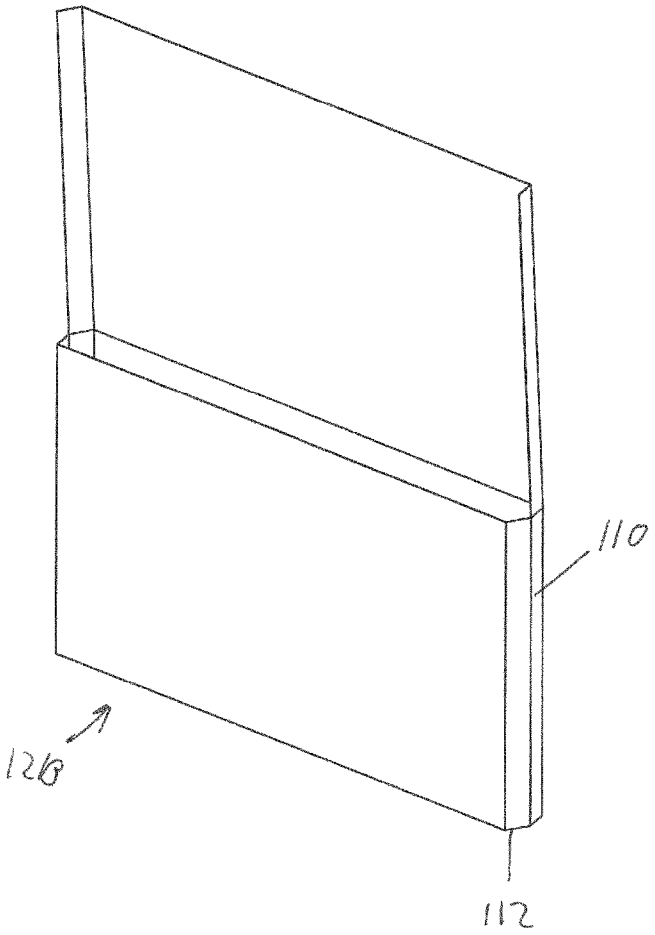
FIG. 14 shows a block-bottom tobacco pouch.
Figure 13:
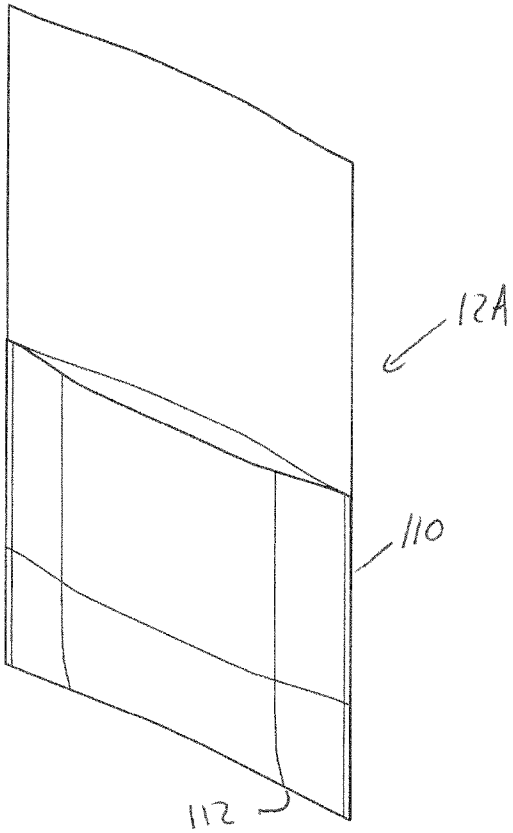
FIG. 13 shows a pillow tobacco pouch.

Turning to FIGS. 13 and 14 a tobacco pillow pouch 12A and a tobacco block-bottom pouch 12B are shown. The skilled person will see the difference between the pouches, in particular at the sides 110 and the bottom 112. The tobacco pouch may in particular be a pouch for roll-your-own tobacco.

Although the device as a whole has different and distinct parts, these parts are obviously intended to cooperate and to produce a single end product, i.e. the block-bottom pouch.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting, but rather, to provide an understandable description of the invention.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language, not excluding other elements or steps).

Any reference signs in the claims should not be construed as limiting the scope of the claims or the invention. It will be recognized that a specific embodiment as claimed may not achieve all of the stated objects.

The mere fact that certain measures are recited in mutually different dependent claims does not indicate that a combination of these measures cannot be used to advantage.

The following embodiments or aspects of the invention may be combined in any fashion and combination and be within the scope of the present invention, as follows:

Embodiment 1

Device (10) for making tobacco pouches (12) from a film (14), the device comprising:

a first folding station (16) for receiving the film and providing a bottom fold (50) in the film, a buffer station (18) for buffering a length of film having the bottom fold, a second folding station (20) for receiving the film having the bottom fold from the buffer station and providing a first fold (70), a second fold (71) and a third fold (72) in the film for defining the block-bottom, the first fold and third fold having a same fold direction and the second fold being located between the first and third fold and having a counter fold direction, wherein the first folding station is provided upstream of the buffer station and the second folding station is provided downstream from the buffer station.

Embodiment 2

Device according to embodiment 1, wherein:

the first folding station is configured for receiving the film having a substantially horizontal transverse axis (34), wherein the first folding station comprises a folding guide (36) and folding rollers (37A, 37B) for providing the bottom fold and for reorienting the transverse axis of the film from a substantially horizontal orientation to a substantially vertical orientation, wherein the bottom fold defines the lower edge of the film, and wherein the buffer station (18) comprises:

one or more fixed film guides (40A, 40B, 40C) and one or more movable film guides (41A, 41B) which are movable in a reciprocating manner in a direction toward the fixed guides and in a direction away from the fixed guides, an actuator (46) for moving the movable film guides, wherein the fixed and movable film guides together define a zig-zag trajectory (43) for the film having a variable length for varying the total length of film in the buffer station, and wherein the buffer station is constructed to guide the film in a substantially horizontal transport direction, and wherein the buffer station is constructed to guide the film in a substantially vertical orientation, wherein the second folding station comprises:

a widening member (60) which extends substantially in a transport direction of the film, and wherein the film is moved along both a left side (61A) and a right side (61B) of said widening member, the bottom fold being moved underneath the widening member, wherein a width (64) of the widening member increases in the transport direction (47), wherein a bottom part (66) of the film is widened by the widening member when moving along the underside of the widening member, and a folding member (68) which is constructed to engage the widened bottom part of the film from below and push upwardly into the widened bottom part for creating the first fold, second fold and third fold in the film, wherein the second folding station is constructed to process the film in a substantially vertical orientation, and wherein the second folding station is constructed to guide the film in a substantially horizontal transport direction.

Embodiment 3

Device according to embodiment 1, wherein the first folding station is configured for receiving the film having a substantially horizontal transverse axis (34), wherein the first folding station comprises a folding guide (36) and folding rollers (37A, 37B) for providing the bottom fold and for reorienting the transverse axis of the film from a substantially horizontal orientation to a substantially vertical orientation, wherein the bottom fold defines the lower edge of the film.

Embodiment 4

Device according to embodiment 3, wherein the folding guide has a triangular shape wherein in top view the triangle points in the transport direction, the folding guide having a tip which forms the most downstream part of the folding guide.

Embodiment 5

Device according to any of embodiments 3-4, wherein the folding guide is oriented downward when viewed in the transport direction, wherein the tip of the folding guide is the lowermost part of the folding guide.

Embodiment 6

Device according to any of embodiment 3-5, wherein the folding guide has a left edge (140A) and a right edge (140B) wherein in use the film slides along the folding guide and is folded upwardly along the left and right edge, resulting in a folded film having a vertical orientation and a left part (51) and a right part (52), wherein in particular the left and right part have different sizes.

Embodiment 7

Device according to any of embodiments 3-6, wherein the tip (38) of the folding guide (36) defines the bottom fold in the film.

Embodiment 8

Device according to any of embodiments 3-7, wherein the first folding station comprises two vertical rollers (37A, 37B) positioned just downstream of the folding guide (36), wherein the film travels through the rollers for pressing the folded film onto itself, thereby making the fold a lasting fold.

Embodiment 9

Device according to any of the preceding embodiments, wherein the bottom fold extends in the longitudinal direction of the film.

Embodiment 10

Device according to any of the preceding embodiments 1 and 2-9, wherein the buffer station (18) comprises:

one or more fixed film guides (40A, 40B, 40C) and one or more movable film guides (41A, 41B) which are movable in a reciprocating manner in a direction toward the fixed guides and in a direction away from the fixed guides, an actuator (46) for moving the movable film guides, wherein the fixed and movable film guides together define a zig-zag trajectory (43) for the film having a variable length for varying the total length of film in the buffer station.

Embodiment 11

Device according to any of the preceding embodiments, wherein the buffer station receives the film in the folded state, the film having a single bottom fold, and is configured to buffer the film having a single bottom fold.

Embodiment 12

Device according to any of the preceding embodiments, wherein the buffer station is configured to receive the film while it travels at an essentially constant speed and is configured to transform this essentially constant movement into a stop-go movement and to pay out the film in the stop—go movement, the film having a takt time and a travel distance between two stops.

Embodiment 13

Device according to any of the preceding embodiments, wherein the one or more movable film guides (41A, 41B) are fixed to one another via a base part (44) which slides along one or more rails in a reciprocating manner, wherein the actuator is connected to and acts on the base part.

Embodiment 14

Device according to any of the preceding embodiments 1 and 2-13, wherein the buffer station is constructed to guide the film in a substantially horizontal transport direction.

Embodiment 15

Device according to any of the preceding embodiments, wherein the fixed and movable film guides are rollers which extend vertically.

Embodiment 16

Device according to any of the preceding embodiments 1 and 2-15, wherein the buffer station is constructed to guide the film in a substantially vertical orientation.

Embodiment 17

Device according to any of the preceding embodiments 1 and 2-16, wherein the second folding station comprises:

a widening member (60) which extends substantially in a transport direction of the film, and wherein the film is moved along both a left side (61A) and a right side (61B) of said widening member, the bottom fold being moved underneath the widening member, wherein a width (64) of the widening member increases in the transport direction (47), wherein a bottom part (66) of the film is widened by the widening member when moving along the underside of the widening member, and a folding member (68) which is constructed to engage the widened bottom part of the film from below and push upwardly into the widened bottom part for creating the first fold, second fold and third fold in the film.

Embodiment 18

Device according to embodiment 17, wherein the folding member has a pointy upper tip (74), in particular having a triangular shape.

Embodiment 19

Device according to embodiment 17 or 18, wherein the second folding station comprises a pair of folding rollers (74A, 74B) positioned downstream from the folding member for pressing the folded film onto itself for creating lasting folds.

Embodiment 20

Device according to any of embodiments 17-19, wherein a guiding plate (76) extends from the folding member (68) and through a gap between the folding rollers to a position downstream of the folding rollers, wherein the film is pressed against both sides of the plate by the respective rollers.

Embodiment 21

Device according to any of embodiments 17-20, wherein the widening member has a height (80) and an underside (67), the underside being in particular a horizontal surface, and an upper side, wherein the widening member is oriented vertically, and wherein the widening member in particular has a widening section (81) and a uniform section (82), the widening section having a width which increases in the transport direction and the uniform section being provided downstream from the widening section and having a width which is uniform in the transport direction.

Embodiment 22

Device according to any of embodiments 17-21, wherein the folding member is configured to engage the film at the bottom fold (50) thereby reversing the direction of the bottom fold (50) in order to transform the bottom fold into the second fold (71).

Embodiment 23

Device according to any of embodiments 17-22, wherein the folding member (68) of the second folding station is positioned downstream from the widening member (60) of the second folding station.

Embodiment 24

Device according to any of embodiments 17-23, wherein an upper tip (74) of the folding member (68) of the second folding station is located higher than an underside (67) of the widening member of the second folding station.

Embodiment 25

Device according to any of the preceding embodiments 1 and 2-24, wherein the second folding station is constructed to process the film in a substantially vertical orientation.

Embodiment 26

Device according to any of the preceding embodiments 1 and 2-25, wherein the second folding station is constructed to guide the film in a substantially horizontal transport direction.

Embodiment 27

Device according to any of the preceding embodiments, wherein the first fold, the second fold and the third fold extend in the longitudinal direction of the film.

Embodiment 28

Device according to any of the preceding embodiments, wherein the device further comprises a welding station (22) for welding seams in the film for defining individual pouches by applying heat, the welding station being positioned downstream from the second folding station.

Embodiment 29

Device according to embodiment 28, comprising a first path (90) extending between the buffer station and the second folding station and a second path (91) extending between the buffer station and the welding station, wherein the device is constructed to alternate between a block-bottom mode and a pillow mode, wherein:

in the block-bottom mode the film is conveyed via the first path to the second folding station for making block-bottom pouches and in the pillow mode the film bypasses the second folding station via the second path in order to make pillow-shaped pouches instead of block-bottom pouches or wherein at least the widening member and the folding member of the second folding station are removable for allowing the film to pass the second folding station without any folding step taking place.

Embodiment 30

Device according to any of the preceding embodiments, comprising:

a support frame (24), a feed station (26) having at least one reel holder (28) for holding a reel (30) on which the film is spooled and being configured to pay out the film from the reel, the welding station for welding seams in the film for defining individual pouches, wherein the feed station, the first folding station, the buffer station, the second folding station and the welding station are mounted on the same support frame.

Embodiment 31

Device according to any of the preceding embodiments, wherein in top view the buffer station, the second folding station and the welding station are arranged in a triangle.

Embodiment 32

Device according to any of the preceding embodiments, wherein there is no processing step between the first folding station and the buffer station nor between the buffer station and the second folding station.

Embodiment 33

Device according to any of the preceding embodiments, comprising a film forming station which is positioned upstream of the first folding station, the film forming station having:

at least one guide for a first plastic film for forming a first outer layer, at least one insert unit for a paper or cardboard strip for forming a middle layer, at least one guide for a second plastic film for forming a second outer layer, wherein the film forming station is constructed to provide the paper or cardboard strip between the two plastic films and to interconnect the three layers into a single film.

Embodiment 34

Method of making tobacco pouches from a film, the method comprising:

providing a bottom fold in the film, buffering a length of film, providing a first fold, a second fold and a third fold in the film for defining the block-bottom, the first fold and third fold having a same fold direction and the second fold being located between the first and third fold and having a counter fold direction, wherein the bottom fold is provided prior to the buffering and the first fold, second fold and third folds are provided after the buffering.

Embodiment 35

Method according to the previous method embodiments, wherein the film comprises at least three layers:

a first outer layer (100) made from plastic, a second outer layer (102) made from plastic, and a middle layer (101) positioned between the first and second outer layer, the middle layer being made from paper or cardboard.

Embodiment 36

Method according to embodiment 35, wherein:

the first folding station receives the film having a substantially horizontal transverse axis (34), wherein the first folding station comprises a folding guide (36) and folding rollers (37A, 37B) and provides the bottom fold and reorients the transverse axis of the film from a substantially horizontal orientation to a substantially vertical orientation, wherein the bottom fold defines the lower edge of the film, and wherein the buffer station (18) comprises:

one or more fixed film guides (40A, 40B, 40C) and one or more movable film guides (41A, 41B) which move in a reciprocating manner in a direction toward the fixed guides and in a direction away from the fixed guides, an actuator (46) which moves the movable film guides, wherein the fixed and movable film guides together define a zig-zag trajectory (43) for the film having a variable length and vary the total length of film in the buffer station, and wherein the buffer station guides the film in a substantially horizontal transport direction, and wherein the buffer station guides the film in a substantially vertical orientation, wherein the second folding station comprises:

a widening member (60) which extends substantially in a transport direction of the film, and wherein the film is moved along both a left side (61A) and a right side (61B) of said widening member, the bottom fold being moved underneath the widening member, wherein a width (64) of the widening member increases in the transport direction (47), wherein a bottom part (66) of the film is widened by the widening member while moving along the underside of the widening member, and a folding member (68) which engages the widened bottom part of the film from below and pushes upwardly into the widened bottom part and creates the first fold, second fold and third fold in the film, wherein the second folding station processes the film in a substantially vertical orientation, and wherein the second folding station is constructed to guide the film in a substantially horizontal transport direction.

Embodiment 37

Method of any of the previous method embodiments, wherein the tobacco pouch is a pouch for roll-your-own tobacco.

Embodiment 38

Method of any of the previous method embodiments, wherein the film is an endless film sheet which is spooled from a roll (30).

Embodiment 39

Method of any of the previous method embodiments, wherein the film is buffered in a folded state, having a single bottom fold (50).

While various embodiments of the present invention are specifically illustrated and/or described herein, it will be appreciated that modifications and variations of the present invention may be effected by those skilled in the art without departing from the spirit and intended scope of the invention. Still further, any of the embodiments or aspects of the invention as described in the claims or in the specification may be used with one and another without limitation.

The invention claimed is:

1. A device for making tobacco pouches from a film, the device comprising:

a first folding station for receiving the film and providing a bottom fold in the film;

a buffer station for buffering a length of film having the bottom fold; and a second folding station for receiving the film having the bottom fold from the buffer station and providing a first fold, a second fold and a third fold in the film for defining the block-bottom, the first fold and third fold having a same fold direction and the second fold being located between the first and third fold and having a counter fold direction;

wherein the first folding station is provided upstream of the buffer station and the second folding station is provided downstream from the buffer station;

wherein the second folding station comprises:

a widening member which extends substantially in a transport direction of the film, and wherein the film is moved along both a left side and a right side of said widening member, the bottom fold being moved underneath the widening member, wherein a width of the widening member increases in the transport direction, wherein a bottom part of the film is widened by the widening member when moving along the underside of the widening member, and a folding member which is constructed to engage the widened bottom part of the film from below and push upwardly into the widened bottom part for creating the first fold, second fold and third fold in the film.

2. The device according to claim 1, wherein the first folding station is configured for receiving the film having a substantially horizontal transverse axis, wherein the first folding station comprises a folding guide and folding rollers for providing the bottom fold and for reorienting the transverse axis of the film from a substantially horizontal orientation to a substantially vertical orientation, wherein the bottom fold defines the lower edge of the film; and wherein the buffer station comprises:

one or more fixed film guides; and one or more movable film guides which are movable in a reciprocating manner in a direction toward the fixed guides and in a direction away from the fixed guides; and an actuator for moving the movable film guides;

wherein the fixed and movable film guides together define a zig-zag trajectory for the film having a variable length for varying the total length of film in the buffer station;

wherein the buffer station is constructed to guide the film in a substantially horizontal transport direction;

wherein the buffer station is constructed to guide the film in a substantially vertical orientation; and wherein the second folding station comprises:

a widening member which extends substantially in a transport direction of the film, and wherein the film is moved along both a left side and a right side of said widening member, the bottom fold being moved underneath the widening member, wherein a width of the widening member increases in the transport direction, wherein a bottom part of the film is widened by the widening member when moving along the underside of the widening member; and a folding member which is constructed to engage the widened bottom part of the film from below and push upwardly into the widened bottom part for creating the first fold, second fold and third fold in the film;

wherein the second folding station is constructed to process the film in a substantially vertical orientation; and wherein the second folding station is constructed to guide the film in a substantially horizontal transport direction.

3. The device according to claim 1, wherein the first folding station is configured for receiving the film having a substantially horizontal transverse axis;

wherein the first folding station comprises a folding guide and folding rollers for providing the bottom fold and for reorienting the transverse axis of the film from a substantially horizontal orientation to a substantially vertical orientation; and wherein the bottom fold defines the lower edge of the film.

4. The device according to claim 3, wherein the folding guide has a left edge and a right edge wherein in use the film slides along the folding guide and is folded upwardly along the left and right edge, resulting in a folded film having a vertical orientation and a left part and a right part, wherein in particular the left and right part have different sizes.

5. The device according to claim 1, wherein the buffer station comprises:

one or more fixed film guides;

one or more movable film guides which are movable in a reciprocating manner in a direction toward the fixed guides and in a direction away from the fixed guides; and an actuator for moving the movable film guides;

wherein the fixed and movable film guides together define a zig-zag trajectory for the film having a variable length for varying the total length of film in the buffer station.

6. The device according to claim 1, wherein the buffer station receives the film in the folded state, the film having a single bottom fold, and is configured to buffer the film having a single bottom fold.

7. The device according to claim 1, wherein the buffer station is configured to receive the film while it travels at an essentially constant speed and is configured to transform this essentially constant movement into a stop-go movement and to pay out the film in the stop-go movement, the film having a cycle time and a travel distance between two stops.

8. The device according to claim 1, wherein the folding member has a pointy upper tip, in particular having a triangular shape.

9. The device according to claim 1, wherein the second folding station comprises a pair of folding rollers positioned downstream from the folding member for pressing the folded film onto itself for creating lasting folds.

10. The device according to claim 1, wherein a guiding plate extends from the folding member and through a gap between the folding rollers to a position downstream of the folding rollers, wherein the film is pressed against both sides of the plate by the respective rollers.

11. The device according to claim 1, wherein the widening member has a height and an underside, the underside being in particular a horizontal surface, and an upper side;

wherein the widening member is oriented vertically; and wherein the widening member in particular has a widening section and a uniform section, the widening section having a width which increases in the transport direction and the uniform section being provided downstream from the widening section and having a width which is uniform in the transport direction.

12. The device according to claim 1, wherein the folding member is configured to engage the film at the bottom fold thereby reversing the direction of the bottom fold in order to transform the bottom fold into the second fold.

13. The device according to claim 1, wherein the folding member of the second folding station is positioned downstream from the widening member of the second folding station.

14. The device according to claim 1, wherein an upper tip of the folding member of the second folding station is located higher than an underside of the widening member of the second folding station.

15. The device according to claim 1, wherein the second folding station is constructed to guide the film in a substantially horizontal transport direction.

16. The device according to claim 1, wherein the device further comprises a welding station for welding seams in the film for defining individual pouches by applying heat, the welding station being positioned downstream from the second folding station, the device comprising a first path extending between the buffer station and the second folding station and a second path extending between the buffer station and the welding station, wherein the device is constructed to alternate between a block-bottom mode and a pillow mode, wherein:

in the block-bottom mode the film is conveyed via the first path to the second folding station for making block-bottom pouches and in the pillow mode the film bypasses the second folding station via the second path in order to make pillow-shaped pouches instead of block-bottom pouches, or wherein at least the widening member and the folding member of the second folding station are removable for allowing the film to pass the second folding station without any folding step taking place.

17. The device according to claim 1, wherein there is no processing device between the first folding station and the buffer station nor between the buffer station and the second folding station.

18. A method of making tobacco pouches from a film, the method comprising:

providing a bottom fold in the film in a first folding station;

buffering a length of film in a buffer station; and providing a first fold, a second fold and a third fold in the film in a second folding station for defining the block-bottom, the first fold and third fold having a same fold direction and the second fold being located between the first and third fold and having a counter fold direction;

wherein the bottom fold is provided prior to the buffering and the first fold, second fold and third folds are provided after the buffering; and wherein the second folding station comprises:

a widening member which extends substantially in a transport direction of the film, and wherein the film is moved along both a left side and a right side of said widening member, the bottom fold being moved underneath the widening member, wherein a width of the widening member increases in the transport direction, wherein a bottom part of the film is widened by the widening member when moving along the underside of the widening member, and a folding member which is constructed to engage the widened bottom part of the film from below and push upwardly into the widened bottom part for creating the first fold, second fold and third fold in the film.

19. The method according to claim 18, wherein:

the first folding station receives the film having a substantially horizontal transverse axis, wherein the first folding station comprises a folding guide and folding rollers and provides the bottom fold and reorients the transverse axis of the film from a substantially horizontal orientation to a substantially vertical orientation, wherein the bottom fold defines the lower edge of the film; and wherein the buffer station comprises:

one or more fixed film guides; and one or more movable film guides which move in a reciprocating manner in a direction toward the fixed guides and in a direction away from the fixed guides;

an actuator which moves the movable film guides, wherein the fixed and movable film guides together define a zig-zag trajectory for the film having a variable length and vary the total length of film in the buffer station, and wherein the buffer station guides the film in a substantially horizontal transport direction, and wherein the buffer station guides the film in a substantially vertical orientation;

wherein the second folding station comprises:

a widening member which extends substantially in a transport direction of the film, and wherein the film is moved along both a left side and a right side of said widening member, the bottom fold being moved underneath the widening member, wherein a width of the widening member increases in the transport direction, wherein a bottom part of the film is widened by the widening member while moving along the underside of the widening member, and a folding member which engages the widened bottom part of the film from below and pushes upwardly into the widened bottom part and creates the first fold, second fold and third fold in the film, wherein the second folding station processes the film in a substantially vertical orientation, and wherein the second folding station is constructed to guide the film in a substantially horizontal transport direction.

* * * * *